US007826771B2

(12) United States Patent
Yamamoto et al.

(10) Patent No.: US 7,826,771 B2
(45) Date of Patent: Nov. 2, 2010

(54) ELECTROSTATIC LATENT IMAGE HOLDER UNIT AND IMAGE FORMING APPARATUS USING THE SAME

(75) Inventors: Mitsuo Yamamoto, Kanagawa (JP); Katsuya Takenouchi, Kanagawa (JP); Yasutomo Ishii, Kanagawa (JP); Junichi Ichikawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 677 days.

(21) Appl. No.: 11/826,320

(22) Filed: Jul. 13, 2007

(65) Prior Publication Data

US 2008/0193164 A1 Aug. 14, 2008

(30) Foreign Application Priority Data

Nov. 27, 2006 (JP) ..... P2006-318526

(51) Int. Cl.
*G03G 15/01* (2006.01)

(52) U.S. Cl. ..... 399/179; 399/299

(58) Field of Classification Search ..... 399/170, 399/179, 223, 299
See application file for complete search history.

(56) References Cited

U.S. PATENT DOCUMENTS

2003/0215726 A1* 11/2003 Sugino et al. ..... 399/299 X
2007/0047992 A1* 3/2007 Kubo ..... 399/71

FOREIGN PATENT DOCUMENTS

| | | | |
|---|---|---|---|
| JP | 05265298 A | * | 10/1993 |
| JP | A-10-078708 | | 3/1998 |
| JP | A-2004-242057 | | 9/2000 |
| JP | A-2005-107366 | | 4/2005 |

* cited by examiner

*Primary Examiner*—David M Gray
*Assistant Examiner*—Erika Villaluna
(74) *Attorney, Agent, or Firm*—Morgan, Lewis & Bockius LLP

(57) ABSTRACT

An electrostatic latent image holder unit includes: first and second electrostatic latent image holders that have first and second functional layers, respectively, the first functional layer being different from the second functional layer in component ratio, and holds an electrostatic latent image on a surface thereof; a contact type charging unit that is in contact with the first electrostatic latent image holder to charge a surface of the first electrostatic latent image holders at a predetermined electric potential level; a non-contact type charging unit that are spaced from the second electrostatic latent image holder, and charge a surface of the second electrostatic latent image holder at a predetermined electric potential level; an exposure unit that exposes the first and second electrostatic latent image holders to form an electrostatic latent image; and a development unit that develops the first and second electrostatic latent image with toner to form a toner image.

6 Claims, 7 Drawing Sheets

30A≒30B
30Ac>30Bc
30Ab<30Bb

ELECTROSTATIC LATENT IMAGE HOLDER UNIT AND IMAGE FORMING APPARATUS USING THE SAME

CROSS-REFERENCE TO RELATED APPLICATIONS

This application is based on and claims priority under 35 U.S.C. 119 from Japanese Patent Application No. 2006-318526 filed Nov. 27, 2006.

BACKGROUND

1. Technical Field

The present invention relates to an electrostatic latent image holder unit and to an image forming apparatus using the electrostatic latent image holder unit.

2. Related Art

Hitherto, there has been known what is called a tandem type color image forming apparatus in which a plurality of photoreceptors are provided side by side along an intermediate transfer member. Generally, in such a tandem type color image forming apparatus, the frequency of forming a monochrome (or black-and-white) image is higher than that of forming a color image. In the case of forming a monochrome image, usually, a process speed (i.e., a circumferential speed of each photoreceptor) is increased.

SUMMARY

According to an aspect of the present invention, an electrostatic latent image holder unit including: first and second electrostatic latent image holders that have first and second functional layers, respectively, the first functional layer being different from the second functional layer in component ratio, and holds an electrostatic latent image on a surface thereof; a contact type charging unit that is in contact with the first electrostatic latent image holder to charge a surface of the first electrostatic latent image holders at a predetermined electric potential level; a non-contact type charging unit that is provided on position facing the second electrostatic latent image holder, are spaced from the second electrostatic latent image holder, and charge a surface of the second electrostatic latent image holder at a predetermined electric potential level; an exposure unit that exposes the first and second electrostatic latent image holders to form an electrostatic latent image; and a development unit that develops the first and second electrostatic latent image with toner to form a toner image.

BRIEF DESCRIPTION OF THE DRAWINGS

Exemplary embodiment of the present invention will be described in detail based on the following figures, wherein:

FIG. 3A illustrates the component ratio among the functional layers in the electrostatic latent image holder. FIG. 3B is a schematic view illustrating the component ratio among the functional layers of the electrostatic latent image holder;

DETAILED DESCRIPTION

Hereinafter, an exemplary embodiment according to the invention is described with reference to the accompanying drawings.

Figure 1:
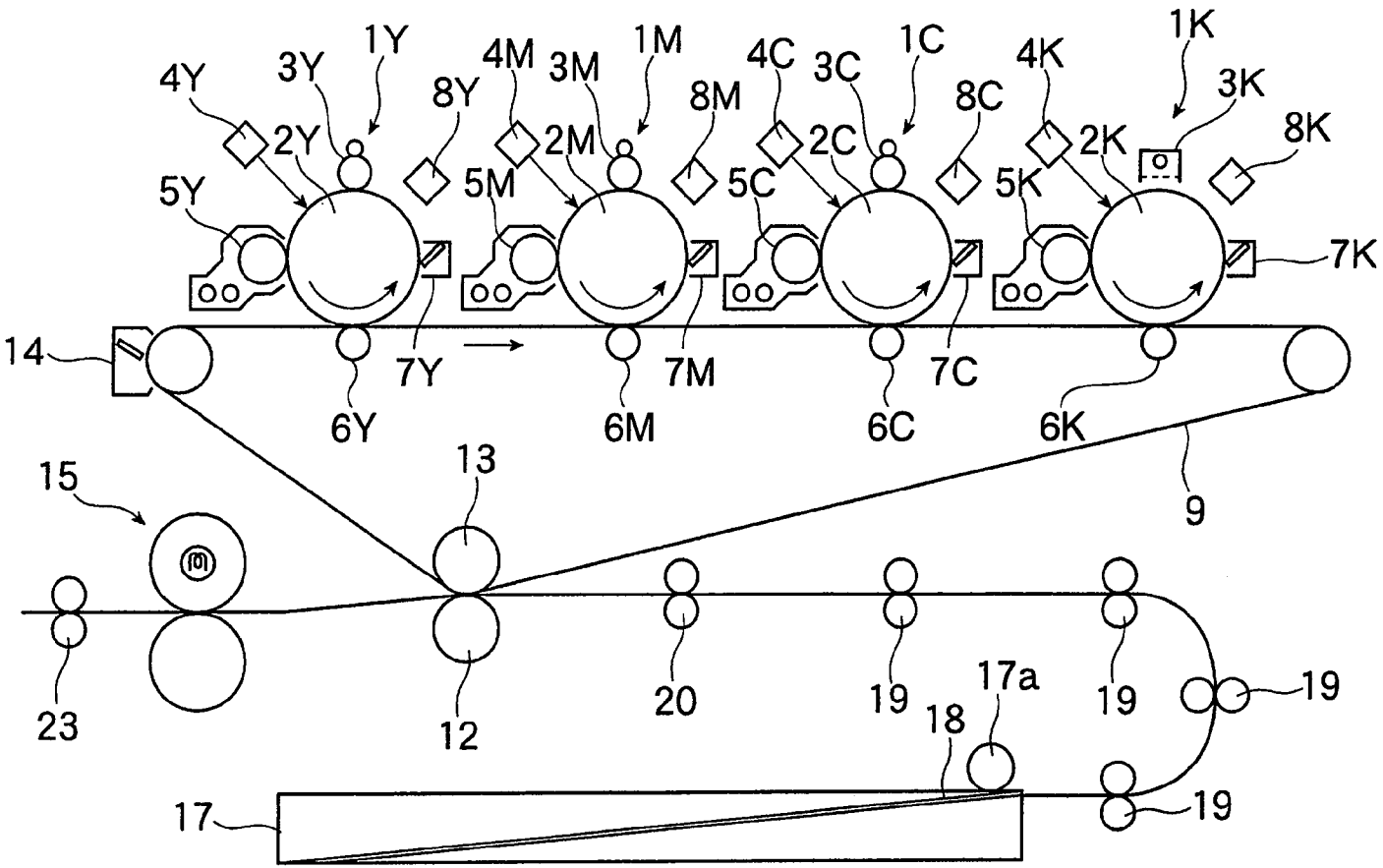
FIG. 1 is a view illustrating the general configuration of an embodiment of an image forming apparatus according to the invention.

First, an outline of the configuration of an image forming apparatus according to the exemplary embodiment of the invention is described below by referring to FIG. 1. FIG. 1 is a view illustrating the general configuration of the embodiment of the image forming apparatus according to the exemplary embodiment of the invention.

Color image information representing a color original read by an image reading unit (not shown) or color image information sent from a personal computer (not shown) or a data input unit (not shown) is input to this image information apparatus 100 which performs image processing on the input image information.

In FIG. 1, reference characters 1Y, 1M, 1C, and 1K designate image forming units form toner images respectively having colors that are yellow (Y), magenta (M), cyan (C), and black (K). The image forming units 1M, 1C, and 1K are disposed in series in this order on an endless intermediate transfer belt 9, which is tightly stretched by a plurality of stretching-rolls, in the direction of movement thereof. The intermediate transfer belt 9 is an intermediate transfer element onto which toner images respectively having the colors are transferred. This intermediate transfer element 9 is inserted between a group of photoreceptors 2Y, 2M, 2C, and 2K serving as electrostatic latent image holders of the image forming units 1Y, 1M, 1C, and 1K and a group of primary transfer rolls 6Y, 6M, 6C, and 6K respectively facing the photoreceptors 2Y, 2M, 2C, and 2K. The intermediate transfer element 9 is formed to be able to circularly move in the direction of an arrow. Toner images multiply transferred onto the intermediate transfer belt 9 are collectively transferred onto recording-paper 18 which serves as a recording medium and is supplied from a paper feeding cassette 17. Subsequently, the transferred images are fixed onto the recording paper 18 by a fixing unit 15. Then, the recording paper 18, on which a color image is formed, is discharged to the exterior of the apparatus.

The image forming units 1Y, 1M, 1C and 1K are constructed basically similarly to one another. Each of the image forming units 1Y, 1M, 1C and 1K roughly includes an associated one of the photoreceptors 2Y, 2M, 2C, and 2K, which is configured to rotate along the direction of an arrow, an associated one of charging units 3Y, 3M, 3C, and 3K, which uniformly charges a surface of an associated one of the photoreceptors 2Y, 2M, 2C, and 2K, an associated one of exposure units 4Y, 4M, 4C, and 4K, which forms an electrostatic latent image on the surface of an associated one of the photoreceptors 2Y, 2M, 2C, and 2K, by exposing an image of an associated one of the colors thereon, an associated one of development units 5Y, 5M, 5C, and 5K, which develops the electrostatic latent image formed on the associated one of the photoreceptors 2Y, 2M, 2C, and 2K, an associated one of cleaning-units 7Y, 7M, 7C, and 7K, and an associated one of neutralization units 8Y, 8M, 8C, and 8K. Incidentally, the present embodiment is configured so that a method of charging the color photoreceptors 2Y, 2M, and 2C differs from that of charging the black photoreceptor 2K, as will be described later. Thus, each of the charging units 3Y, 3M, and 3C respectively corresponding to the color photoreceptors 2Y, 2M, and 2C differs in configuration from the charging unit 3K corresponding to the black photoreceptor 2K. In the present embodiment, the image forming units 1Y, 1M, 1C and 1K correspond to the electrostatic latent image holder units. Each of the image forming units 1Y, 1M, 1C and 1K is formed attachably to and detachably from an image forming apparatus body.

In the present embodiment, each of the photoreceptors 2Y, 2M, 2C, and 2K is such that predetermined layers made of an organic photosensitive material, an amorphous selenium-based photosensitive material, an amorphous silicon-based photosensitive material, and the like are coating-formed on a metallic drum which rotates in the direction of an arrow. Incidentally, this layer (hereunder referred to also as a photosensitive layer) has a structure in which a plurality of functional layers are sequentially stacked. The details of this layer will be described later.

Incidentally, the component ratio among the functional layers is defined as a component proportion among the plurality of functional layers constituting the photosensitive layer, for example, a proportion among the thicknesses of the functional layers.

Additionally, in the image forming apparatus according to the present embodiment, a monochrome image forming mode, in which a monochrome image is formed, and a color image forming mode, in which a color image is formed, are provided to be able to be selectively set by an operation panel (not shown). A process speed in the monochrome image forming mode, the frequency of use of which is relatively high, is set to be higher (e.g., (the process speed in the monochrome image forming mode)=1.5×(a process speed in the color image forming mode)) than the process speed in the color image forming mode, the frequency of use of which is relatively low. Additionally, each of the color image forming units 1Y, 1M, and 1C is constructed to be contactable with and separatable from the intermediate transfer belt 9 by a movement mechanism (not shown). Each of the color image forming units 1Y, 1M, and 1C is constructed to be separated from the intermediate transfer belt 9 in the monochrome image forming mode in which the process speed is high.

Also, in the image forming apparatus according to the exemplary embodiment of the invention, the method of charging the photoreceptor is changed according to the photoreceptors 2Y, 2M, 2C, and 2K for the following reasons.

Generally, methods of charging photoreceptors can be classified into a contact type charging method and a non-contact type charging method. Incidentally, the contact type charging method has advantages in that an amount of generated discharge products, such as ozone and nitrogen oxide, due to the influence of discharge is small, and that the contact type charging method excels in environmental and is suitable for miniaturization. In contrast, the non-contact type charging method has advantages in that the charging of a large area can be achieved due to corona discharge, and that the process speed of the photoreceptor is increased, that is, a high process speed of the photoreceptor may be achieved.

Thus, the image forming apparatus according to the present embodiment employs a non-contact type charging means, which is advantageous to achieve a high speed, as the charging unit for the black photoreceptor 2K which is high in process speed and requires a high speed rotation when a monochrome image is formed. Additionally, the image forming apparatus according to the present embodiment employs a contact type charging means, which is advantageous to improve environmental and to achieve miniaturization, as the charging means corresponding to each of the color photoreceptors 2Y, 2M, and 2C to be used when forming a color image which requires a low process speed, as compared with a monochrome image. Therefore, the charging means meet the requirements, such as the speed-up, the miniaturization, and the environmental, according to usage. Next, the charging methods according to the present embodiment are described below.

In the present embodiment, first, a contact type charging units (BCR: Bias Charged Rolls) 3Y, 3M, and 3C are used as the charging unit corresponding to the photoreceptors 2Y, 2M, and 2C respectively constituting the color image forming units 1Y (yellow), 1M (magenta), and 1C (cyan). More specifically, a direct current component of a voltage/current, on which an alternating current component is superimposed, is applied onto the charging rolls 3Y, 3M, and 3C each of which is disposed to be in contact with a surface of an associated one of the photoreceptors 2Y, 2M, and 2C (from above in the present embodiment). Consequently, a gap discharge is caused in a micro-gap from each of the charging rolls 3Y, 3M, and 3C to the associated one of the photoreceptors 2Y, 2M, and 2C. Accordingly, a surface (or photosensitive layer) of each of the photoreceptors 2Y, 2M, and 2C is charged at a predetermined potential level. Each of the charging rolls 3Y, 3M, and 3C according to the present embodiment can be configured by coating a surface of a core bar made of metal, such as stainless steel, with an electrically conductive layer made of an electrically conductive synthetic resin or rubber, whose resistance value is adjusted to a predetermined value. As circumstances demand, a demolding layer may be formed on the electrically conductive layer. Then, a voltage is applied to the core bar from a high voltage source (not shown) by a constant current control. For example, in a case where this voltage to be applied is a direct current (DC) voltage, the DC voltage ranges from about (−700) volts to about (−800) volts, which is substantially equal to the charging potential level of the photoreceptor 2K. In a case where the voltage to be applied is an alternating current (AC) voltage, the peak-to-peak voltage Vpp of the AC voltage is about 2.0 kV. The frequency of the AC voltage is about 1.3 kHz. Consequently, each of the photoreceptors 2Y, 2M, and 2C is charged at a predetermined potential level.

On the other hand, a non-contact type charging unit is used as the charging unit corresponding to the photoreceptor 2K constituting the monochrome (or black-and-white) image forming unit 1K. More specifically, a conventionally known scorotron 3K placed at a predetermined offset distance from a surface of the photoreceptor 2K, that is, placed to be in non-contact with the photoreceptor 2K is disposed above the photoreceptor 2K as the charging unit corresponding to the photoreceptor 2K. For example, a DC volt of about (−750) volts, which is substantially equal to the charging potential level of the photoreceptor 2K, is applied from a high voltage power supply (not shown) thereto as a grid voltage. Additionally, an electric current of about (−700)μA is applied to a discharge wire. Consequently, a surface area of the photoreceptor 2K corresponding to a predetermined charged area is charged by corona discharge at a predetermined potential level.

An image forming process in the image forming apparatus constructed in this manner is described below.

In the case of selecting the color image forming mode, a surface (i.e., a photosensitive layer) of each of the color photoreceptors 2Y, 2M, and 2C is uniformly charged by an associated one of the charging rolls 3Y, 3M, and 3C. Also, a surface (i.e., a photosensitive layer) of the black photoreceptor 2K is uniformly charged by the scorotron 3K. Next, scanning exposure is performed on each color image, using laser beams output from exposure units 4Y, 4M, 4C, and 4K with timing determined in consideration of the differences among the relative positions of the image forming units 1Y, 1M, 1C, and 1K according to, for example, image information read by the image reading apparatus. Thus, electrostatic latent images respectively corresponding to color images are formed on surfaces (or photosensitive layers) of the photoreceptors 2Y, 2M, 2C, and 2K. The electrostatic latent images respectively corresponding to color images are developed by the development units 5Y, 5M, 5C, and 5K into color toner images. The primary transfer of full-color toner images, which are serially superimposed, onto the intermediate transfer belt 9 is performed by the pressure-contact force and the electrostatic attraction force of the primary transfer rolls 6Y, 6M, 6C, and 6K constituting a part of primary transfer means.

On the other hand, in the case of selecting the monochrome image forming mode, the color image forming units 1Y, 1M, 1C, and 1K move apart from the intermediate transfer belt 9. The black photoreceptor 2K and the intermediate transfer belt 9 rotate at high speed corresponding to a high process speed (e.g., 1.5 times the process speed in the color image forming mode). Then, similarly to the case where a color image is formed, a surface (or photosensitive layer) of the black photoreceptor 2K is uniformly charged at a predetermined potential level by the scorotron 3K. A monochrome (or black) toner image is formed on the surface (or photosensitive layer) of the photoreceptor 2K by the exposure unit 4K and the development unit 5K. This monochrome toner image is primarily transferred onto the intermediate transfer belt 9 by the primary transfer roll 6K.

After the primary transfer, residual color toner on each of the photoreceptors 2Y, 2M, 2C, and 2K is scraped by an associated one of drum cleaning units 7Y, 7M, 7C, and 7K. Subsequently, the surfaces of the photoreceptors 2Y, 2M, 2C, and 2K are neutralized by the neutralization units 8Y, 8M, 8C, and 8K. Then, the surfaces of the photoreceptors 2Y, 2M, 2C, and 2K are charged again by the charging units 3Y, 3M, 3C, and 3K, respectively, for the next image forming cycle.

In the present embodiment, an endless belt formed by shaping a synthetic resin film made of polyimide having flexibility into a belt and connecting both ends of the synthetic resin film belt to each other by means, such as adhesion, can be used as the intermediate transfer belt 9.

Then, the color/monochrome toner images primarily transferred onto the intermediate transfer belt 9 are secondarily transferred onto the recording paper 18 conveyed to a secondary transfer position with predetermined timing by the pressure-contact force and the electrostatic attraction force of the backup roll 13, which supports the intermediate transfer belt 9 from behind, and the secondary transfer roll 12, which is pressure-contacted with the backup roll 13 with predetermined timing in a secondary transfer unit.

On the other hand, a sheet of a predetermined size of the recording paper 18 is supplied by a paper feeding roll 17*a* from a paper feeding cassette 17 serving as a recording paper accommodating portion disposed at a lower part of the image forming apparatus 100. The supplied sheet of the recording paper 18 is conveyed to the secondary transfer position 9 of the intermediate transfer belt 9 with predetermined timing by a plurality of conveyance rolls 19 and a registration roll 20, which determines the position of the paper. Then, as described above, the toner images are collectively transferred onto the recording paper 18 from the surface of the intermediate transfer belt 9 by the backup roll 13 and the secondary transfer roll 12, which serve as secondary transfer means.

The recording paper 18, on which the toner images are secondarily transferred from the surface of the intermediate transfer belt 9, is separated from the intermediate transfer belt 9. Subsequently, the recording paper 18 is conveyed to the fixing unit 15 disposed at the downstream side of the secondary transfer means. This fixing unit 15 fixes the toner images on the recording paper 18 by heat and pressure. After this fixation, the recording paper 18 is discharged through a discharge roll 23 onto a discharge tray (not shown).

Further, residual toner on the intermediate transfer belt 9, which cannot be transferred on the recording paper 18 by the secondary transfer means, is conveyed to a belt cleaning unit 14 by maintaining a state in which the residual toner remains adhering to the surface of the intermediate transfer belt 9. The residual toner is removed from the surface of the intermediate transfer belt 9 by the belt cleaning unit 14.

Meanwhile, although the image forming apparatus of the above configuration meet the requirements, such as high-speed, environmental, and miniaturization, the frequency of use of the color photoreceptors 2Y, 2M and 2C differs from that of use of the black photoreceptor 2K. Thus, the replacing cycles of the photoreceptors 2Y, 2M, and 2C serving as the spare parts, differ from that of the black photoreceptor 2K also serving as the spare part. This may impair the maintainability and the convenience of the photoreceptors for users. Thus, according to the image forming apparatus according to the exemplary embodiment of the invention, the surface layers of the color photoreceptors 2Y, 2M, and 2C are made to differ in composition from that of the black photoreceptor 2K. Consequently, the replacing cycles of the photoreceptors may be uniformized. Hereinafter, the general configuration of each of the layers of the photoreceptors 2Y, 2M, 2C, and 2K according to the present embodiment is described with reference to FIG. 2.

Figure 2:
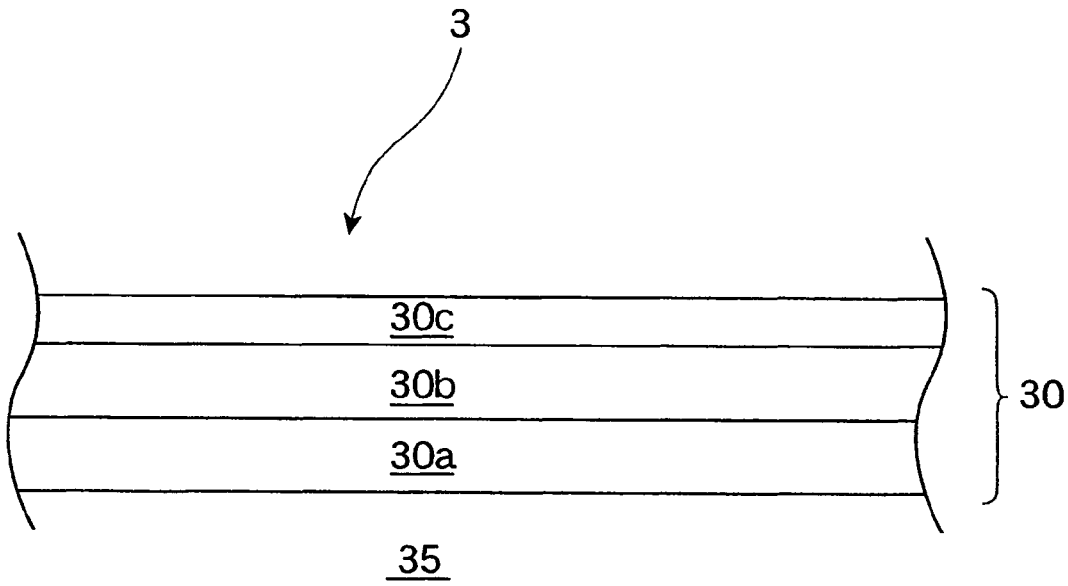
FIG. 2 is a schematic view illustrating the general configuration of a photosensitive layer of an electrostatic latent image holder according to the exemplary embodiment of the invention.

A photosensitive layer 30 illustrated in FIG. 2 is coating-formed on a surface of the photoreceptor 2 according to the present embodiment. The photosensitive layer 30 includes a plurality of functional layers 30*a* to 30*c*. More specifically, a charge generating layer 30*a* serving as a functional layer, which generates electric charges, is stacked on a drum-like electroconductive support 35. A charge transporting layer 30*b* serving as a functional layer, which transports generated charges, is stacked on the charge generating layer 30*a*. Also, a protection layer 30*c*, which is less in wear rate and is higher in hardness than the charge transporting layer 30*b*, is stacked on the charge transporting layer 30*b* as an outermost surface layer.

Incidentally, the wear ratio is a value obtained by dividing, when a predetermined number (e.g., 100,000) of sheets of images are output, a wear amount from an initial thickness of a corresponding photoreceptor by the number of revolutions of the corresponding photoreceptor. That is, the wear ratio is an indicator indicating the wear amount per predetermined number of revolution of the photoreceptor.

Incidentally, a method of measuring the wear ratio in the present embodiment is described below.

1) First, images of the colors and black, each of which has an area coverage (A.C.) of 5%, are arranged to be uniform in the direction of a shaft. Incidentally, the A.C. is a percentage ratio of the total area of the images to the area of the entire recording paper.

2) Next, the number of revolutions of the photoreceptor is set at 100 k cycles (i.e., 100000 revolutions).

3) The photoreceptor is set in the image forming apparatus. Then, the printout of the images is performed.

4) Upon completion of the printout, a wear amount of the photoreceptor per predetermined number of cycles is calculated from the difference between the film thickness of the photoreceptor, which is measured after the printout corresponding to 100 k cycles, and that of the photoreceptor which is unused yet. Thus, the wear ratio (mm/k cycles, or nm/k cycles) is obtained.

There is no particular limit to the electrocondutive support 35. Any electrocondutive support generally used for an electrophotographic photoreceptor can be used as the electrocondutive support 35. The following various known supports can be appropriately used. That is, supports made of a metal, for example, aluminum, copper, iron, zinc and nickel, a sheet of paper, plastics or glass on which a thin film made of a metal, such as aluminum, copper, gold, silver, platinum, palladium, titanium, a nickel-chromium alloy, stainless steel, a copper-indium alloy, indium oxide, or tin oxide is vapor-deposited, a sheet of paper, plastics or glass on which a metallic foil is laminated, a sheet of paper, plastics or glass subjected to an electroconductive treatment by coating a binder resin into which carbon black, indium oxide, tin oxide-antimony oxide powder, metallic powder or copper iodide is dispersed, can be used. Additionally, there is no particular limit to the shape of the electroconductive support 35. The shape can be appropriately selected according to a purpose from, for example, a drum-like shape, a sheet-like shape, a plate-like shape, a plate-like shape, and a pipe-like shape. Further, as circumstances demand, a surface treatment, such as mirror cutting, etching, anodic oxidation, coarse cutting, centerless grinding, sand blasting and wet honing, can be preliminarily applied to the electroconductive support 35. A surface of the support can be roughened by the surface treatment to thereby prevent woodgrain density unevenness from occurring inside the photosensitive layer, which may be caused in the case of using a source of coherent light, such as a laser beam. Such a surface treatment is effective, especially, in the case of using a metallic pipe substrate as the material of the electroconductive support 35. Incidentally, in the present embodiment, the electroconductive supports 35 of the photoreceptors 2Y, 2M, 2C, and 2K are formed so that the diameters of the electroconductive supports 35 are substantially equal to a common value. The expression "substantially equal" means that the outside diameters are within range of about 50 μm, in consideration of what is called outer circumferential deflection.

The charge generating layer 30*a* includes at least a charge generating material. As circumstances demand, the charge generating layer 30*a* includes other ingredients, such as a binder resin.

All of the following known materials can be used as the charge generating material. That is, organic pigments, for example, azo pigments, such as bisazo and trisazo, condensed ring aromatic pigments, such as dibromo-anthoanthrone, perylene pigments, pyrrolopyrrole pigments, and phthalocyanine pigments, and inorganic pigments, such as trigonal selenium and zinc oxide, can be used. In the case of using a light source whose exposure wavelength ranges from 380 nm to 500 nm, an inorganic pigment is favorable as the charge generating material. In the case of using a light source whose exposure wavelength ranges from 700 nm to 800 nm, metal phthalocyanine and metal-free phthalocyanine are favorable as the charge generating material.

The binder resin can be selected from a wide range of insulating resins and organic photoconductive polymers, such as poly-N-vinyl carbazole, polyvinylanthracene, polyvinylpyrene, and polysilane. Favorable binder resins include insulating resins, such as polyvinylbutyral resins, polyalylate resins (e.g., polycondensation polymer of bisphenol-A and phthalic acid), polycarbonate resins, polyester resins, phenoxy resins, polyvinyl chloride acetate copolymer, polyamide resins, acrylate resins, polyacrylamide resins, polyvinylpyridine resins, cellulosic resins, urethane resins, epoxy resins, casein, polyvinyl alcohol resins, and polyvinylpyrrolidone resins. However, the binder resins according to the present embodiment are not limited thereto. These binder resins can be used solely or as a mixture of two or more kinds thereof.

The charge transporting layer 30*b* includes at least a charge transporting material and a binder resin. As circumstances demand, the charge transporting layer 30*b* includes another ingredient.

The charge transfer materials include electron transporting compounds, for example, quinone-based compounds, such as p-benzoquinone, chloranil, bromanil, and anthraquinone, tetracyanoquinodimethane-based compounds, fluorenone-based compounds, such as 2,4,7-trinitrofluorenone, xanthone-based compounds, benzophenone-based compounds, cyanovinyl-based compounds, and ethylene-based compounds, and also include hole transporting compounds, for example, triarylamine-based compounds, benzidine-based compounds, arylalkane-based compounds, aryl-substituted-ethylene-based compounds, stilbene-based compounds, anthracene-based compounds, and hydrazone-based compounds. These charge transporting materials can be used solely or as a mixture of two or more kinds thereof.

The binder resins are, for example, polycarbonate resins, polyester resins, methacrylic resins, acrylic resins, polyvinyl chloride resins, polyvinylidene chloride resins, polystyrene resins, polyvinyl acetate resins, styrene-butadiene copolymer resins, vinylidene-chloride-acrylonitrile copolymer resins, vinyl chloride-vinyl-acetate-maleic-anhydride copolymer resins, silicone resins, silicone-alkyd resins, phenol-formaldehyde resins, styrene-alkyd resins, and polymer charge transporting materials, such as poly-N-vinyl carbazole, and polysilane. These binder resins can be used solely or as a mixture of two or more thereof. Preferably, the compounding ratio between the charge transporting material and the binder resin ranges from 10:1 to 1:5.

Next, the protection layer 30*c* which is the outermost surface layer of the photoreceptor 2 is described below. The protection layer 30*c* has resistance to surface abrasion and flaws and is provided to increase toner transfer efficiency. The protection layer 30*c* according to the present embodiment has a wear ratio of, for example, 1 nm to 10 nm/k cycles, which is lower than that of the charge transporting layer 30*b*, and a hardness which is higher than that of the charge transporting layer 30*b*.

Such a protection layer 30*c* can be constituted by dispersing electroconductive fine particles in a binder resin, or by dispersing lubricative fine particles of, for example, a fluorine resin or an acrylic resin in a charge transporting material, or by using a hard coating agent, such as silicon or acryl. It may be preferable from the viewpoint of strength, electric characteristics, and image quality maintaining properties that the protection layer 30*c* includes a resin having a cross-linking structure. It may be more preferable that the protection layer 30*c* includes a charge transporting material. Incidentally, the charge transporting material reacts with the resin having a cross-linking structure and can be incorporated into the cross-linking structure as a structural unit having a charge transporting function. Various materials can be used as the resin having a cross-linking structure in the protection layer 30*c*, as long as the materials are resins capable of forming a cross-linking structure. From viewpoint of the characteristics, phenol resins, urethane resins, siloxane resins, and epoxy resins are favorable. Among these resins, phenol resins and siloxane resins may be preferable. Particularly, phenol resins may be more preferable. These resins form a dense gas barrier (or protection) film and are low in oxygen transmission coefficient due to an aromatic-ring rich dense structure. The phenol-based material contributes to enhanced resistance to oxidation.

Figure 4:
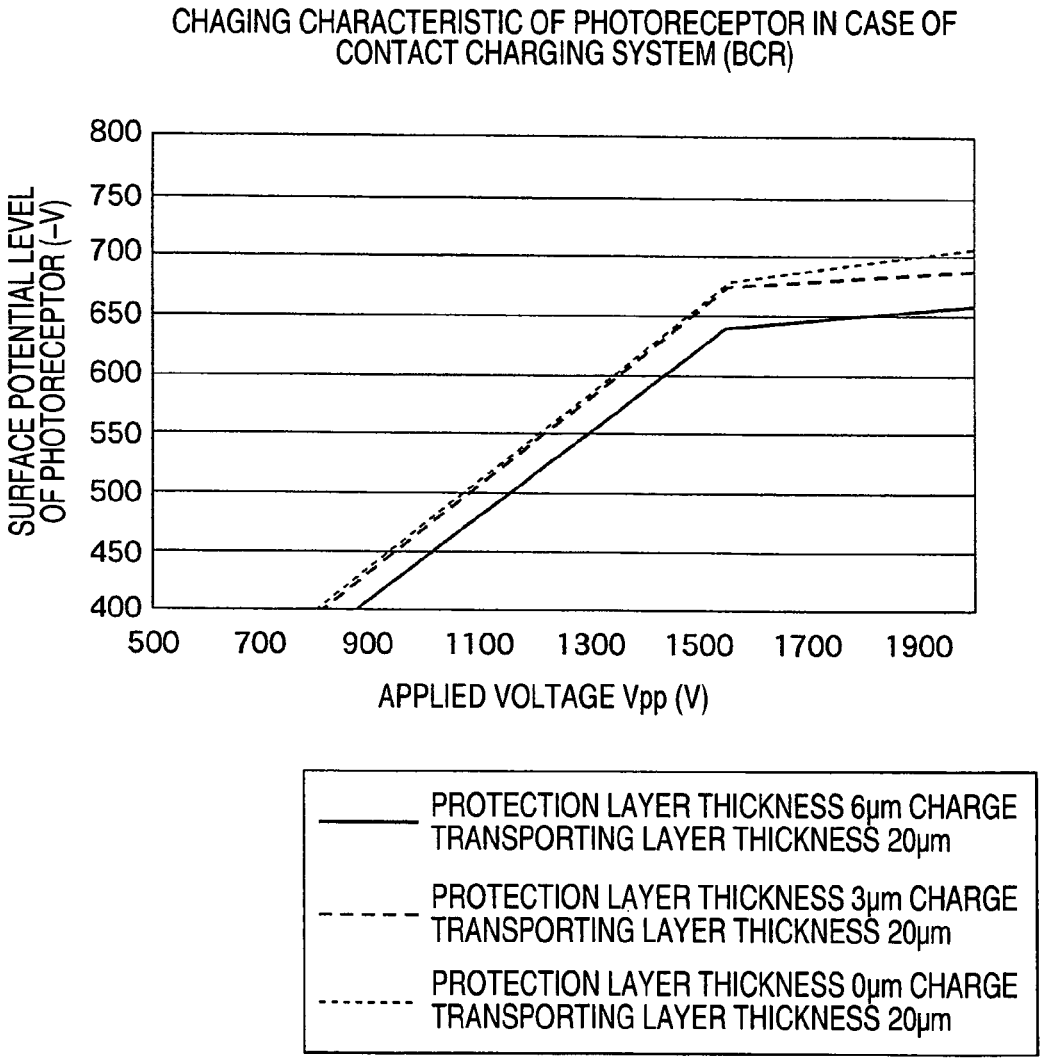
FIG. 4 is a graph illustrating the relation between the thickness and the saturated charging voltage of a protection layer of a contact charging type photoreceptor.
Figure 5:
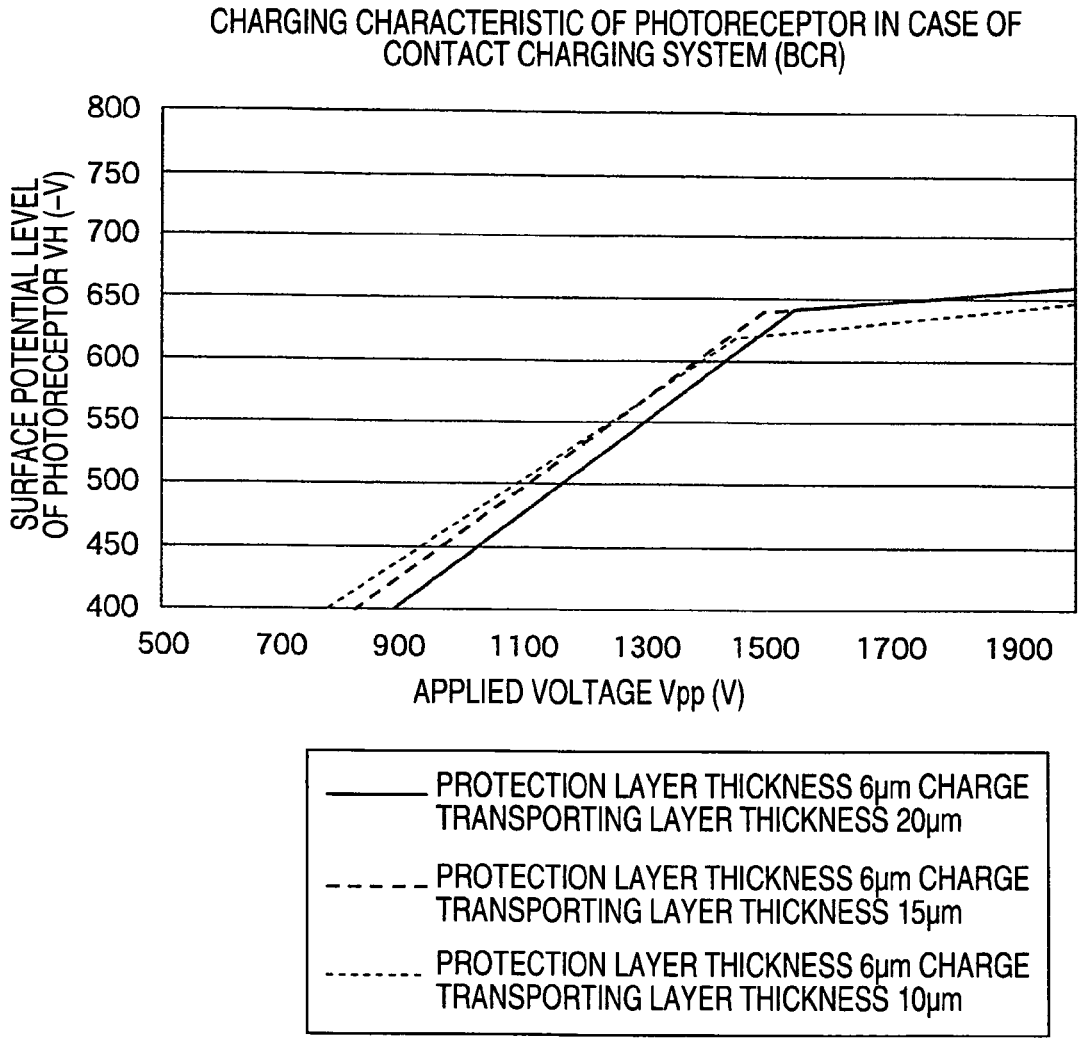
FIG. 5 is a graph illustrating the relation between the thickness of a charge transporting layer and the saturated charging voltage of the protection layer of the contact charging type photoreceptor.
Figure 6:
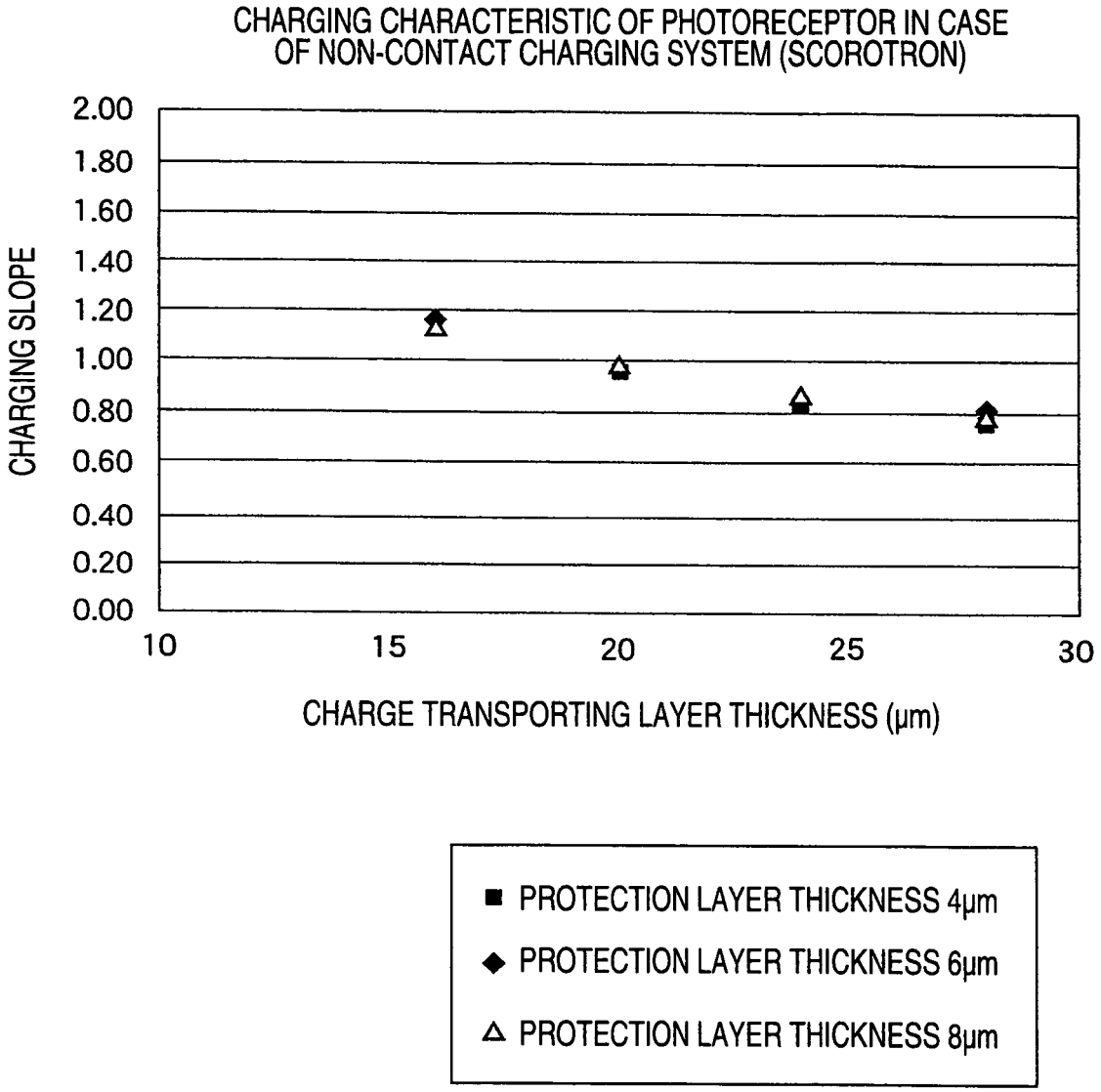
FIG. 6 is a graph illustrating the relation between a total thickness of a photosensitive layer and a protection layer and the charging performance of a non-contact charging type photoreceptor.

Next, results of verification of the relation between the thickness of each functional layer and the above charging method are described with reference to FIGS. 4 to 6. FIG. 4 is a graph illustrating the relation between the thickness and the saturated charging voltage of the protection layer 30*c* in the contact charging type photoreceptor. FIG. 5 is a graph illustrating the relation between the thickness of the charge transporting layer 30*b* and the voltage applied thereto. FIG. 6 is a graph illustrating the relation among the thicknesses of the protection layer 30*c* and the charge transporting layer 30*b* and the charging performance in the non-contact charging type photoreceptor.

First, as is understood from FIG. 4, in the photoreceptor corresponding to the contact charging method (using BCR in this example), when the layer thickness of the protection layer 30*c* was changed (in this example, this thickness was changed among 0 (corresponding to a case where no protection layer is provided), 3 μm, and 6 μm, while the thickness of the charge transporting layer 30*b* was constant and was set to be 20 μm), an applied voltage Vpp (hereunder referred to also as a saturated charging voltage), at which the surface potential level of the photoreceptor 2 was saturated and stabilized, was found to be substantially 1500V or so, independent of the layer thickness. That is, it was found that in the case of the contact charging type photoreceptor, the saturated charging voltages was independent of the thickness of the protection layer 30*c*.

Next, as is understood from FIG. 5, in the photoreceptor corresponding to the contact charging method (using BCR in this example), when the layer thickness of the charge transporting layer 30*b* was changed (in this example, this thickness was changed among 10 μm, 15 μm, and 20 μm, while the thickness of the protection layer 30*c* was constant and was set to be 6 μm), an applied voltage Vpp (hereunder referred to also as a saturated charging voltage), at which the surface potential level of the photoreceptor 2 was saturated and stabilized, was found to be changed among about 1400V, about 1450V, and about 1500V respectively corresponding to the thicknesses of the charge transporting layer 30*b*. That is, it was found that the thicker the charge transporting layer 30*b* became, the saturated charging voltage Vpp increased, and that it was necessary for charging the photosensitive layer at a predetermined potential level to apply a higher voltage thereto. Incidentally, in the case of employing the constant current control, it is necessary for increasing electric current to realize a higher voltage. This indicates that the thicker the charge transporting layer 30*b* becomes in the contact charging type photoreceptor, the charging performance is lowered (that is, the thinner the charge transporting layer 30*b* becomes, the photosensitive layer is more easily charged and has higher charging performance).

On the other hand, as is understood from FIG. 6, it was found that in the photoreceptor corresponding to the non-contact charging method (using a scorotron in this example), even when the layer thickness of the protection layer 30*c* was changed (in this example, this thickness was changed among 4 μm, 6 μm, and 8 μm), the value of a charging slope did not change. Incidentally, the charging slope indicates a rate of change in the surface potential level of the photoreceptor and is an indicator representing the charging performance (i.e., the easiness of charging). Additionally, the smaller the value of the charging slope becomes, the higher the charging performance rises (the more easily the photosensitive layer is charged).

In contrast, as is understood from FIG. 6, it was found that in a case where the layer thickness of the charge transporting layer 30*b* was changed among 16 μm, 20 μm, 24 μm, and 28 μm, the larger the layer thickness became, the value of the charging slope decreased, so that the charging performance was enhanced.

That is, it was found that according to the non-contact charging method, the charging performance was independent of the thickness of the protection layer 30*c* and depended upon the thickness of the charge transporting layer 30*b*. The larger the thickness of the transporting layer 30*b* became, the charging performance was enhanced.

Thus, the photoreceptors 2Y, 2M, 2C, and 2K according to the present embodiment maintain the appropriate charging performance according to the charging method in consideration of the above results of the verification. Also, according to the exemplary embodiment of the invention, in consideration of the frequency of use and the wear ratio of each of the photoreceptors 2Y, 2M, 2C, and 2K, the component ratio among the functional layers 30*a* to 30*c* is made to differ from one another so as to enhance the convenience by uniformizing the replacing cycles of the photoreceptors 2Y, 2M, 2C, and 2K. Hereinafter, the difference in the component ratio among the photosensitive layer 30 according to the present embodiment is described with reference to FIGS. 3A and 3B. Incidentally, in FIGS. 3A and 3B, the photosensitive layer of each of the color photoreceptors 2Y, 2M, and 2C is designated by reference character 30A. The photosensitive layer of the black photoreceptor 2K is designated by reference character 30B. The functional layers of the photosensitive layer 30A are respectively designated by reference characters 30Aa to 30Ac, while those of the photosensitive layer 30B are respectively designated by reference characters 30Ba to 30Bc.

Figure 3A:
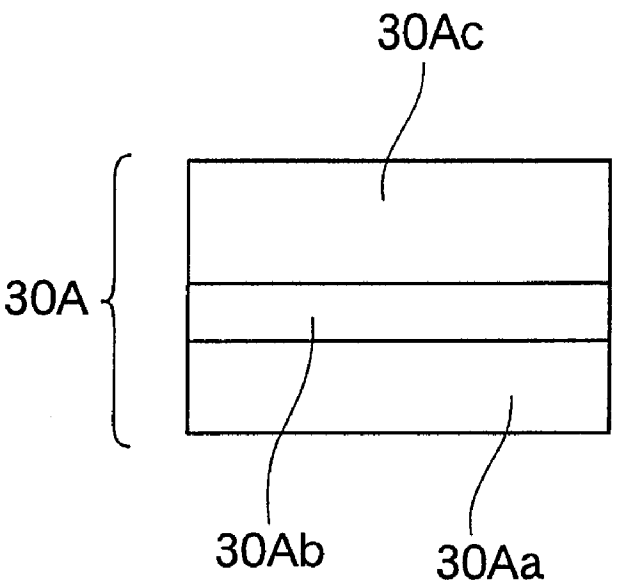
FIGS. 3A and 3B are schematic views illustrating the component ratio among functional layers of the photosensitive layer of the electrostatic latent image holder according to the exemplary embodiment of the invention.
Figure 3B:
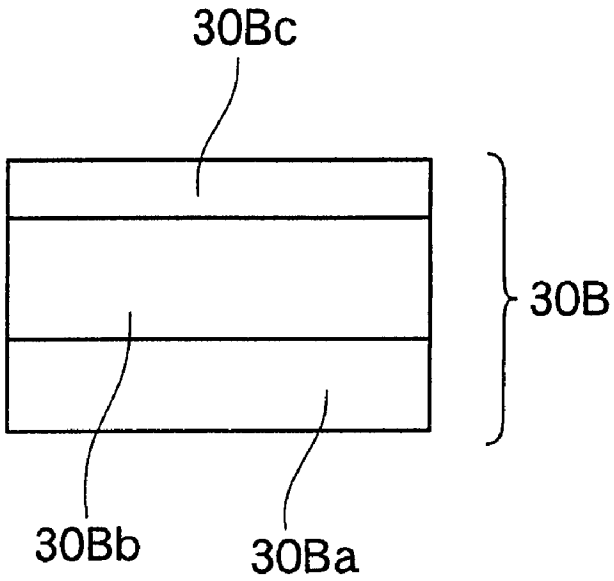

As illustrated in FIGS. 3A and 3B, in the photosensitive layer 30A of each of the contact charging type color photoreceptors 2Y, 2M and 2C, the protection layer 30Ac which is the outermost layer (i.e., the outermost surface layer) is formed in consideration of the wear resistance to be thicker than the protection layer 30Bc of the non-contact charging type black photoreceptor 2K (30Ac>30Bc) On the other hand, the charge transporting layer 30Ab of each of the color photoreceptors 2Y, 2M and 2C is formed in consideration of the charging performance to be thinner than the charge transporting layer 30B of the black photoreceptor 2K (30Ab<30Bb), That is, in each of the contact charging type photoreceptors 2Y, 2M and 2C, which are high in the wear ratio, the thickness of the protection layer 30Ac is increased to increase the component ratio of the protection layer 30Ac of the photosensitive layer 30A. On the other hand, in the non-contact charging type photoreceptor 2K whose charging performance is degraded when the layer thickness of the charge transporting layer 30Bb is decreased, the component ratio of the charge transporting layer 30*b* of the photosensitive layer 30Bb is enhanced by increasing the thickness of the charge transporting layer 30Bb.

More specifically, according to the present embodiment, the photoreceptors are formed so that the thicknesses of the photosensitive layers 30A and 30B are substantially equal to one another (in this example, the thicknesses range from 20 μm to 36 μm (30A≈30B)).

Further, the protection layer 30Ac of each of the color photoreceptors 2Y, 2M, and 2C is formed to have a thickness ranging from 4 μm to 8 μm, while the protection layer 30Bc of each of the monochrome photoreceptors 2K is formed to have a thickness ranging from 2 μm to 6 μm. That is, each of the color photoreceptors 2Y, 2M, and 2C is set so that the component ratio of the protection layer 30Ac of the photosensitive layer 30A ranges from 20% to 40%. In contrast, the monochrome photoreceptor 2K is set so that the component ratio of the protection layer 30Bc of the photosensitive layer 30B ranges from 5% to 20%.

Also, the charge transporting layer 30Ab of each of the color photoreceptors 2Y, 2M and 2C is formed to have a thickness ranging from 12 μm to 28 μm, while the charge transporting layer 30Bb of each of the monochrome photoreceptor 2K is formed to have a thickness ranging from 18 μm to 30 μm. That is, the photosensitive layer 30A of each of the color photoreceptors 2Y, 2M and 2C is set so that the component ratio of the charge transporting layer 30Ab ranges 60% to 77%, while the photosensitive layer 30B of the monochrome photoreceptor 2K is set so that the component ratio of the charge transporting layer 30Bb ranges 83% to 90%.

Incidentally, it is common to the photoreceptors 2Y, 2M, 2C and 2K that the thickness of each of the charge generating layers 30Aa and 30Ba ranges from 0.15 μm to 0.2 μm (i.e., the component ratio of each of the charge generating layers in the photosensitive layer 30 ranges from 0.4% to 1%).

Figure 7A:
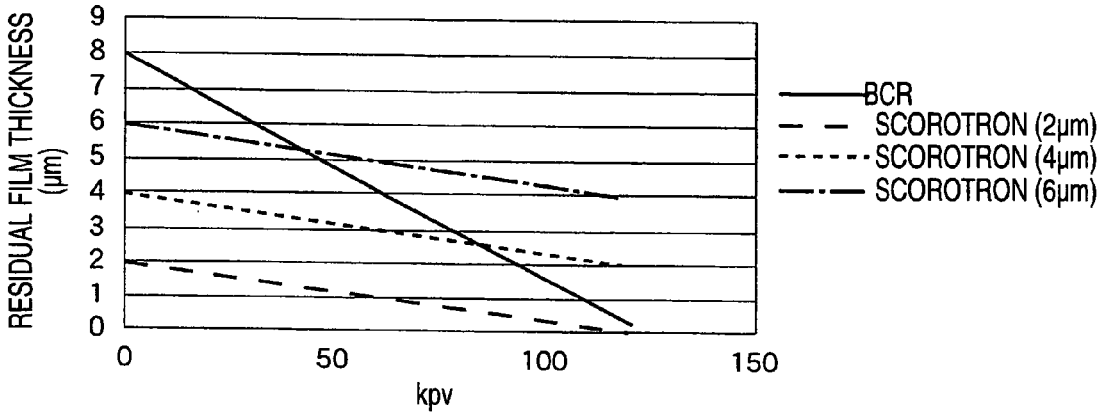
FIGS. 7A to 7C are graphs illustrating results of verifying temporal change of the thickness of each photoreceptor in the case of changing the component ratio among the functional layers.
Figure 7B:
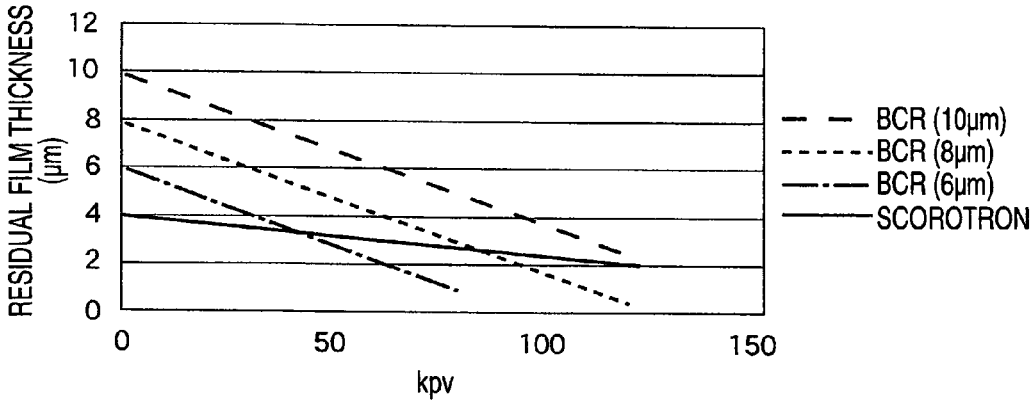
Figure 7C:
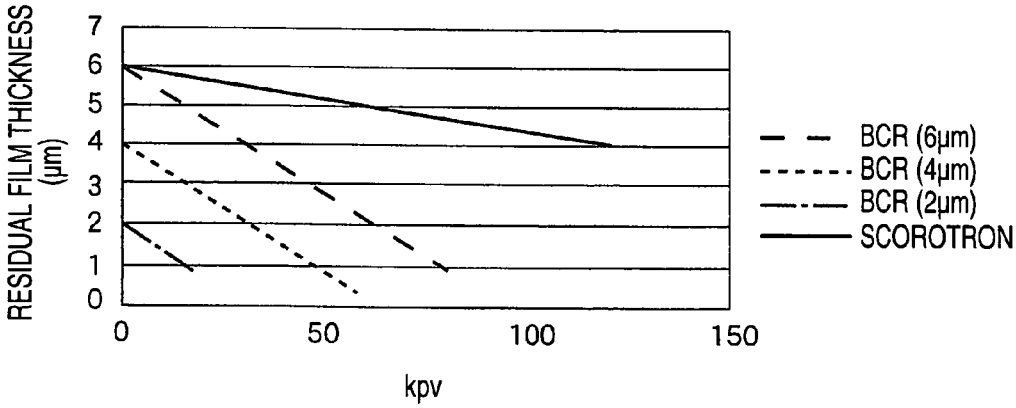

FIGS. 7A to 7C illustrate results of verification of temporal change of the film thickness of each of the photoreceptors in a case where the component ratio of each of the functional layers 30*a* to 30*c* of the photoreceptors 2Y, 2M, 2C, and 2K is made to differ from one another. Incidentally, FIG. 7A illustrates a temporal residual-film thickness (μm) of each of the protection layer 30Ac of each of the photoreceptors (2Y, 2M, and 2C in this example) corresponding to the BCR and the protection layer 30Bc of the photoreceptor (2K in this example) corresponding to the scorotron in a case where the thickness of the protection layer 30Ac was maintained at a constant value (i.e., an initial thickness of 8 μm in this example) and where the thickness of the protection layer 30Bc was changed (i.e., changed among 6 μm, 4 μm, and 2 μm). FIG. 7B illustrates a temporal residual-film thickness (μm) of each of the protection layer 30Ac of each of the photoreceptors (2Y, 2M, and 2C in this example) corresponding to the BCR and the protection layer 30Bc of the photoreceptor (2K in this example) corresponding to the scorotron in a case where the thickness of the protection layer 30Bc was maintained at a constant value (i.e., an initial thickness of 4 μm in this example) and where the thickness of the protection layer 30Ac was changed (i.e., changed among 10 μm, 8 μm, and 6 μm). Also, FIG. 7C illustrates a temporal residual-film thickness (μm) of each of the protection layer 30Ac of each of the photoreceptors (2Y, 2M, and 2C in this example) corresponding to the BCR and the protection layer 30Bc of the photoreceptor (2K in this example) corresponding to the scorotron in a case where the thickness of the protection layer 30Bc was maintained at a constant value (i.e., an initial thickness of 6 μm in this example) and where the thicknesses of the protection layers 30Ac were substantially equal to one another or thinned (i.e., changed among 6 μm, 4 μm, and 2 μm).

It is found that in the case where the protection layer 30Ac of each of the photoreceptors 2Y, 2M, and 2C corresponding to the BCR is thicker than the protection layer 30Bc of the photoreceptor 2K corresponding to the scorotron 3K, as illustrated in FIGS. 7A and 7B, the replacing cycle of each of the photoreceptors 2Y, 2M, and 2C corresponding to the BCR may be made to be close to that of the photoreceptor 2K corresponding to the scorotron 3K, and the photoreceptor 2K may be used over a long term (i.e., the replacing cycle can be prolonged) until the thickness of the protection layer 30Bc is reduced to substantially zero.

On the other hand, it is found that as illustrated in FIG. 7C, in the case where the thickness of the protections layer 30Ac of each of the photoreceptors 2Y, 2M, and 2C corresponding to the BCR is made to be substantially equal to or less than the thickness of the protection layer 30Bc of the photoreceptor 2K corresponding to the scorotron, the gradient of a straight line representing the residual-film thickness of the protection layer 30Ac of each of the photoreceptors 2Y, 2M, and 2C corresponding to the BCR is larger than that of a straight line representing the residual-film thickness of the protection layer 30Bc of the photoreceptor 2K corresponding to the scorotron 3K, that thus, the replacing cycles of the photoreceptors 2Y, 2M, and 2C may not be made to be close to that of the photoreceptor 2K, and that the replacing cycles may not be prolonged.

Thus, it has been confirmed that the replacing cycles of the photoreceptors 2Y, 2M, 2C and 2K may be uniformized by simultaneously maintaining the appropriate charging performance according to the charging methods corresponding to the photoreceptors 2Y, 2M, 2C, and 2K and by setting the component ratio of each of the functional layers 30*a* to 30*c* of the photoreceptors 2Y, 2M, 2C, and 2K as described above.

Incidentally, according to the present embodiment, the photosensitive layers 30 of the photoreceptors 2Y, 2M, 2C, and 2K are formed to have a substantially equal thickness (i.e., a substantially equal total thickness of the functional layers of the photosensitive layer 30). However, the electrostatic latent image holder unit according to the exemplary embodiment of the invention is not limited to that configured so that the thicknesses of the photosensitive layers 30 are substantially equal to one another. Additionally, as a result of forming the photosensitive layers 30 to have a substantially equal to one another, the outside diameters of the photoreceptors 2Y, 2M, 2C, and 2K are made to be substantially equal to one another. Consequently, the standardization and the communization of members disposed around drums may be achieved.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. An electrostatic latent image holder unit comprising:

first and second electrostatic latent image holders that have first and second functional layers, respectively, the first functional layer being different from the second functional layer in component ratio, and holds an electrostatic latent image on a surface thereof;

a contact type charging unit that is in contact with the first electrostatic latent image holder to charge a surface of the first electrostatic latent image holders at a predetermined electric potential level;

a non-contact type charging unit that is provided on position facing the second electrostatic latent image holder, are spaced from the second electrostatic latent image holder, and charge a surface of the second electrostatic latent image holder at a predetermined electric potential level;

an exposure unit that exposes the first and second electrostatic latent image holders to form an electrostatic latent image; and a development unit that develops the first and second electrostatic latent image with toner to form a toner image, wherein each of the first and second functional layers includes a protection layer that is provided on an outermost surface of each of the first and second electrostatic latent image holders, and a charge transporting layer that is provided on an inner side of the protection layer, and the protection layer has wear rate being less than wear rate of the charge transporting layer.

2. The electrostatic latent image holder unit as claimed in claim 1, wherein the protection layer of the first electrostatic latent image holder has thickness being more than thickness of the protection layer of the second electrostatic latent image holder.

3. The electrostatic latent image holder unit as claimed in claim 2, wherein the protection layer contains a phenol resin having a cross-linking structure.

4. The electrostatic latent image holder unit as claimed in claim 1, wherein the charge transporting layer of the first electrostatic latent image holder has thickness being less than thickness of the charge transporting layer of the second electrostatic latent image holder.

5. The electrostatic latent image holder unit as claimed in claim 1, wherein the first and second electrostatic latent image holders have diameter being substantially equal each other, and the first and second functional layers have total thickness being substantially equal each other.

6. An image forming apparatus which comprises:

first and second electrostatic latent image holder units as claimed in claim 1; and a transferring unit that transfers a toner image formed on each of the first and second electrostatic latent image holders to a transfer medium, the image forming apparatus having a color image forming mode in which a color image is formed, and a monochrome image forming mode in which a monochrome image is formed, and each of the first and second electrostatic latent image holders in the monochrome image forming mode having a circumferential speed being less than a circumferential speed thereof in the color image forming mode.

* * * * *